United States Patent [19]

Haack

[11] 4,296,964

[45] Oct. 27, 1981

[54] STRUCTURAL COMPONENT FOR UPHOLSTERED FURNITURE AND METHOD OF MAKING

[75] Inventor: Dennis A. Haack, Troy, Ohio

[73] Assignee: Denack Design Corporation, Troy, Ohio

[21] Appl. No.: 75,449

[22] Filed: Sep. 14, 1979

[51] Int. Cl.[3] ..... A47C 31/02

[52] U.S. Cl. ..... 297/218; 5/406; 5/471; 297/219; 297/441; 297/452

[58] Field of Search ..... 297/218, 219, 220, 227, 297/229, 445, 446, 461, 452, 445, DIG. 1, 441; 5/471, 472, 443, 478, 408; 29/91, 91.2, 91.5

[56] References Cited

U.S. PATENT DOCUMENTS

| | | | |
|---|---|---|---|
| 1,524,045 | 1/1925 | Lichter . | |
| 2,178,670 | 11/1939 | Menge . | |
| 2,326,441 | 8/1943 | Cunningham | 5/471 |
| 3,170,222 | 2/1965 | Doerer | 29/91.2 |
| 3,283,345 | 11/1966 | Berck | 5/471 |
| 3,506,987 | 5/1970 | Bielak | 5/471 X |
| 3,596,989 | 8/1971 | Van Ryn | 297/219 |
| 4,059,306 | 11/1977 | Harder, Jr. | 297/218 |

*Primary Examiner*—James T. McCall
*Attorney, Agent, or Firm*—Jacox and Meckstroth

[57] ABSTRACT

A structural component for upholstered furniture includes a three-dimensional frame consisting of a plurality of wires which are welded together. A flexible sheet substrate and an upholstery material cover are secured together, with padding held between the substrate and the cover. Clips pierce the substrate and engage the frame such that the upholstery is fastened to the frame.

16 Claims, 13 Drawing Figures

STRUCTURAL COMPONENT FOR UPHOLSTERED FURNITURE AND METHOD OF MAKING

BACKGROUND OF THE INVENTION

The present invention relates to a structural component for upholstered furniture and, more particularly, to such a component in which the padding and upholstery material is fastened over a three-dimensional wire frame by means of clips.

Conventional construction techniques for upholstered furniture require substantial time and skill on the part of the workers fabricating the upholstered furniture. Initially, a wood frame, such as shown in U.S. Pat. No. 3,256,041, issued June 14, 1966, to Armstrong, is constructed. Thereafter, the frame may be covered with padding material and upholstery material is stretched over the padding material and fastened to the frame to form the finished piece of furniture. Considerable time is required in order to produce a neat, finished appearance.

Additionally, since the padding is compressed substantially by the upholstery material in conventional furniture constructions, the tension to which this material is stretched prior to fastening to the wooden frame is a significant factor in the dimensions of the various portions of the finished chair. If, for instance, the fabric covering the arms of a chair is stretched too tightly, the padding material may be compressed to the point where the distance between the arms is too great. As a result, the cushion manufactured to rest on the seat of the chair may not fill the space between the arms completely. Additional problems may also arise where the upholstery material utilized carries a pattern. If, for instance, the upholstery material is striped, it is desirable that the stripes extend in proper alignment across the various component portions of the piece of furniture. This alignment of patterns in the upholstery fabric between various components requires additional time and effort on the part of the worker assembling the piece of furniture.

The wood frame structure found in conventional upholstered furniture construction also has a number of disadvantages. First, construction of the frame is a time consuming process. Second, a wood frame is susceptible to damage as a result of high humidity. Finally, such a frame is relatively heavy.

Various approaches have been taken to improving the construction of upholstered furniture. U.S. Pat. No. 3,759,571, issued Sept. 18, 1973, to Korch, discloses an upholstered chair having a skeletal frame to which molded side arms formed of a reinforced rigid foam are secured. Pre-upholstered side arm cushions overlie the rigid foam side arms and are secured thereto. The seat construction of Korch, nevertheless, requires substantial skill on the part of the worker assembling the chair.

A wire frame chair is disclosed in U.S. Pat. No. 3,834,759, issued Sept. 10, 1974, to Panton, in which the supporting frame is composed of a plurality of substantially identical frame members, closed in themselves, and arranged in spaced relation to each other. Each of the frame members is formed of bent wire and transverse frame elements interconnect the frame members. While providing a wire frame chair which eliminates the problems associated with wood frame upholstery, the Panton concept is severely limited in the designs of the furniture which can be produced, since each of the frame members is identical in shape. Additionally, there is no suggestion in Panton of a method for upholstering the chair so produced. Rather, Panton simply suggests using cushions which overlie, and are supported by the frame.

It is seen, therefore, that there is a need for a simplified construction for upholstered furniture components in which upholstery material and padding is used to cover a supporting wire frame with the upholstery material and padding being secured to the frame in a manner requiring relatively little time and skill on the part of a worker.

SUMMARY OF THE INVENTION

A structural component for upholstered furniture has a three-dimensional frame consisting of a plurality of wires which are welded together. Upholstery means is provided having a flexible sheet substrate and an upholstery material cover secured thereto, with padding means held between said substrate and said cover. Clip means pierce the substrate and engages the frame, whereby the upholstery means is fastened to the frame.

The three-dimensional frame may include a first outer wire mat and a second inner wire mat, welded to the outer wire mat. The frame may also include a plurality of means on the second wire mat for engaging respective ones of the clip means. The upholstery means comprises a flexible sheet substrate of appropriate shape for covering the frame and padding means adhesively mounted on the flexible sheet substrate. The upholstery means further comprises an upholstery material cover, covering the padding means and sewn to the flexible sheet substrate adjacent the periphery thereof. The upholstery material cover leaves at least a portion of the periphery of the flexible sheet substrate exposed.

The clip means may each comprise a clip having a frame engaging portion piercing the flexible sheet substrate and a clip head on the opposite side of the substrate from the frame engaging portion. The frame engaging portion may extend from the flexible sheet substrate on the same side thereof as the upholstery material cover. The flexible sheet substrate is folded adjacent its periphery such that the exposed portion of the substrate periphery is on the opposite side of the upholstery means from the upholstery material cover. The folded portion of the substrate is adhesively secured together to maintain the fold, with the clip heads of the clip means held within the fold.

The padding means may comprise a sheet of foam material which is secured to the flexible sheet substrate by pressure-sensitive tape having adhesive on both sides thereof. The folded portion of the substrate may be secured by means of a pressure-sensitive tape having adhesive on both sides thereof.

The upholstered furniture component is made according to the following method:

- forming a wire frame having multiple wire mats welded together,
- providing a sheet of flexible material of appropriate shape for covering the wire frame,
- piercing the sheet at points adjacent its periphery with a plurality of clips, the clips having frame engaging portions extending from the sheet,
- adhesively bonding padding material to the sheet on the same side of the sheet as the frame engaging portions of the clips, sewing upholstery material to the sheet around the periphery thereof to cover the padding material, where leaving at least a portion of the periphery of the sheet exposed, folding over the periphery of the sheet such that the frame engaging portions extend outwardly on the opposite side thereof from the upholstery material, wrapping the sheet on the frame such that the frame is covered, and engaging a mat of the frame with the clips to form a finished component.

Accordingly, it is a object of the present invention to provide a structural component for upholstered furniture in which a multiple mat wire frame is covered with padding and upholstery material which is secured to the frame by means of clips; to provide such a structural component in which the padding and upholstery material are secured to a substrate sheet of flexible material; to provide such a structural component in which the clips are secured to an inner mat of the wire frame; and to provide such a structural component in which the clips pierce the periphery of the substrate sheet, which periphery is folded prior to attachment of the clips to the frame.

Other objects and advantages of the invention will be apparent from the following description, the accompanying drawings and the appended claims.

DETAILED DESCRIPTION OF THE PREFERRED EMBODIMENT

Figure 1:
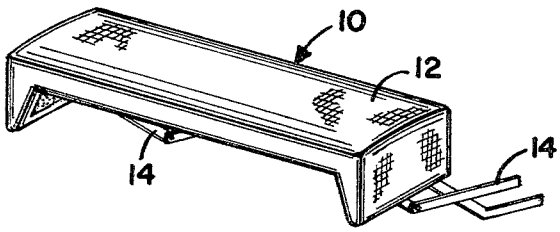
FIG. 1 is a perspective view of a structural component embodying the present invention.
Figure 2:
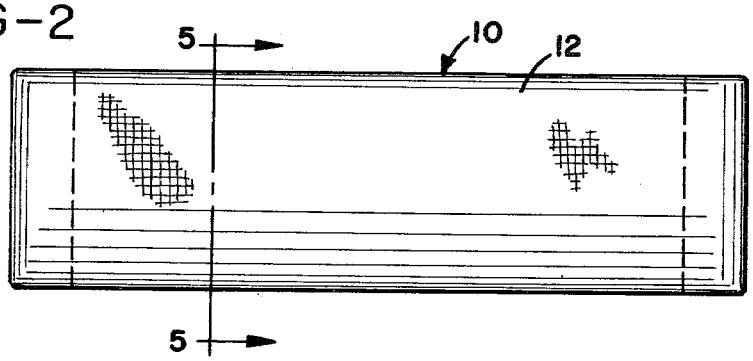
FIG. 2 is a plan view of the component of FIG. 1.
Figure 3:
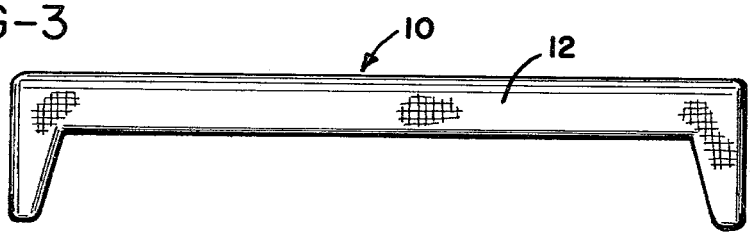
FIG. 3 is a front view of the component of FIG. 1.
Figure 4:
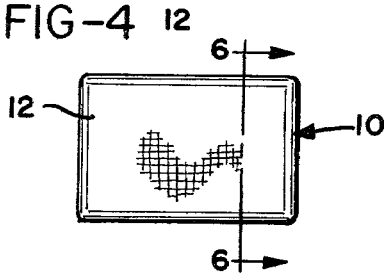
FIG. 4 is a side view of the component of FIG. 1.

Reference is made to FIGS. 1–4 which illustrate a foot rest embodying the present invention. Although a foot rest is shown and described herein, it will be appreciated by those skilled in the art that the present invention is applicable to other structural components for upholstered furniture, such as chair arms and backs. As seen in FIG. 1, the foot rest 10 is covered with an upholstery material cover 12. A pantograph type linkage arrangement 14 is secured to the bottom of the foot rest and supports the foot rest during use, as well as extending and retracting the foot rest with respect to a recliner chair to which the pantograph linkage arrangement 14 is secured.

Figure 5:
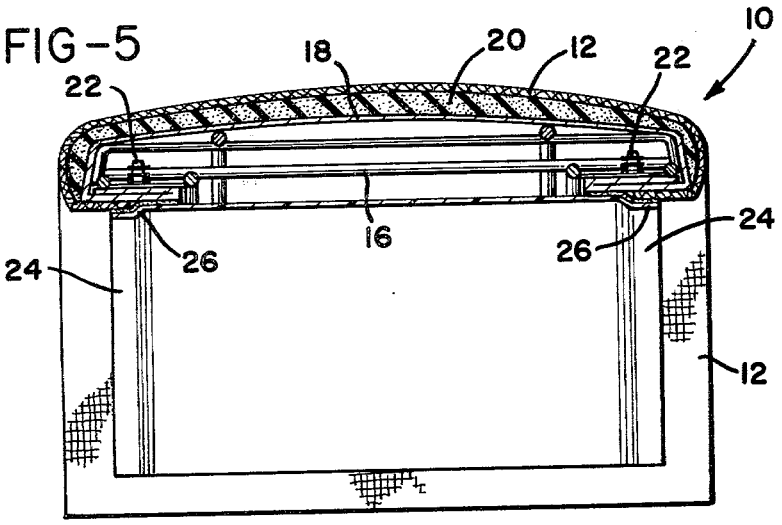
FIG. 5 is a sectional view, taken generally along line 5—5 in FIG. 2.
Figure 6:
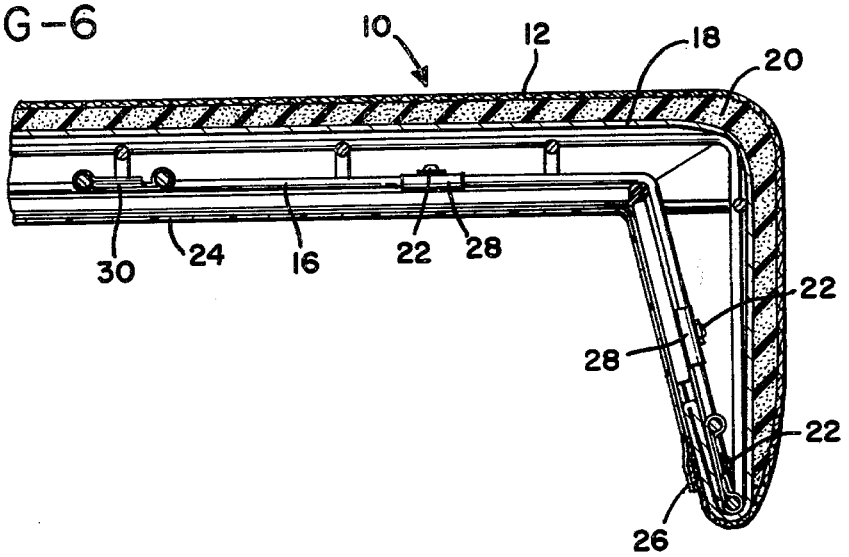
FIG. 6 is a partial sectional view, taken generally along line 6—6 in FIG. 4.

FIGS. 5 and 6 are sectional views illustrating the construction of the component of the present invention. A three-dimensional frame 16 consists of a plurality of wires which are welded together in the shape required by the structural component. The frame 16 is covered by an upholstery means which includes a flexible sheet substrate 18 and an upholstery material cover 12 secured thereto with padding means 20 held between the substrate 18 and the cover 12. The flexible sheet substrate may be constructed of any suitable material, such as, for example, relatively stiff cardboard. The padding means may comprise a layer of foam material, such as a foamed polymer material. Clip means 22 pierce the substrate 18 and engage the frame 16, thus fastening the upholstery means securely to the frame 16.

A sheet of cover material 24 is secured to the bottom portion of the upholstery means by double-sided pressure-sensitive adhesive tape 26 such that the frame 16 is completely enclosed. A plurality of clip engaging brackets 28 are attached to the frame 16 and are appropriately positioned to be engaged by the clip means 22. Additionally, brackets 30 are provided on the frame 16 for engaging bolts (not shown) in ends of the pantograph linkage arrangement 14.

Figure 7:
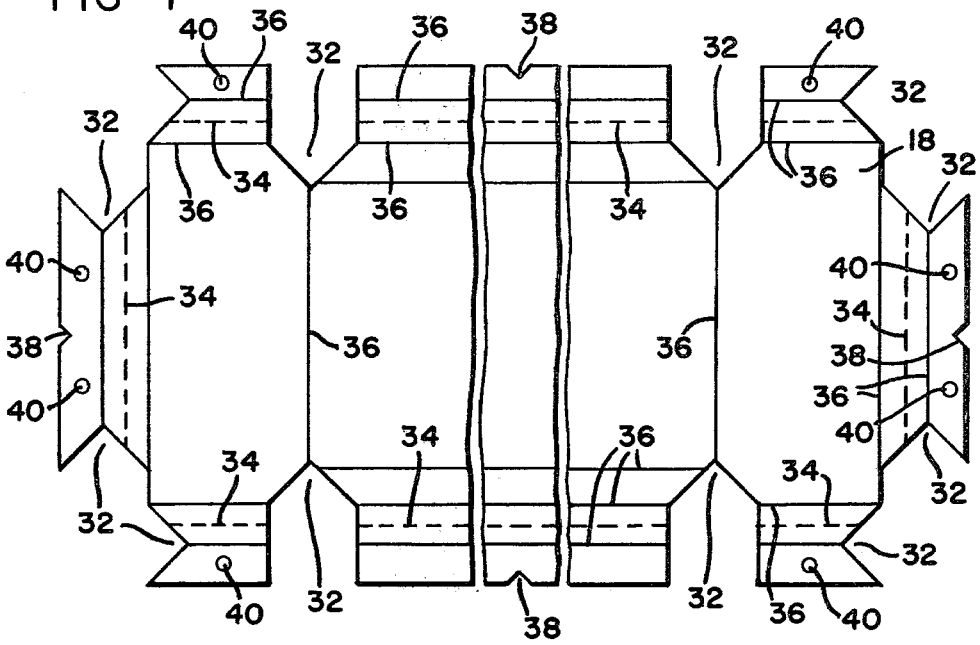
FIG. 7 is a plan view of a flexible sheet substrate with portions broken away.

FIGS. 7–10 illustrate the details of the construction of the upholstery means, including the flexible sheet substrate 18, the padding means 20, and the upholstery material cover 12. As seen in FIG. 7, the flexible sheet substrate 18 is appropriately shaped for covering the frame. A number of cutouts 32, dictated by the shape of the frame to be covered, are provided around the periphery of the substrate 18 to permit the substrate to be wrapped neatly around the frame. The substrate 18 also includes printed sewing lines 34 which assist a worker during an operation in which the upholstery material cover 12 is sewed to the substrate 18, as described more completely below. A plurality of fold lines 36 are indicated. The substrate 18 will preferably be scored along fold lines 36 to facilitate folding of the substrate along these lines. Alignment notches 38 are also provided along the periphery of the substrate 18 to assist a worker in properly aligning upholstery material which is to be sewn to the substrate 18. Notches 38 are particularly advantageous where the upholstery material includes a pattern which must be precisely aligned. The substrate 18 also includes a plurality of holes 40 along its periphery which are positioned to receive clips 22 as more fully described below.

Figure 8:
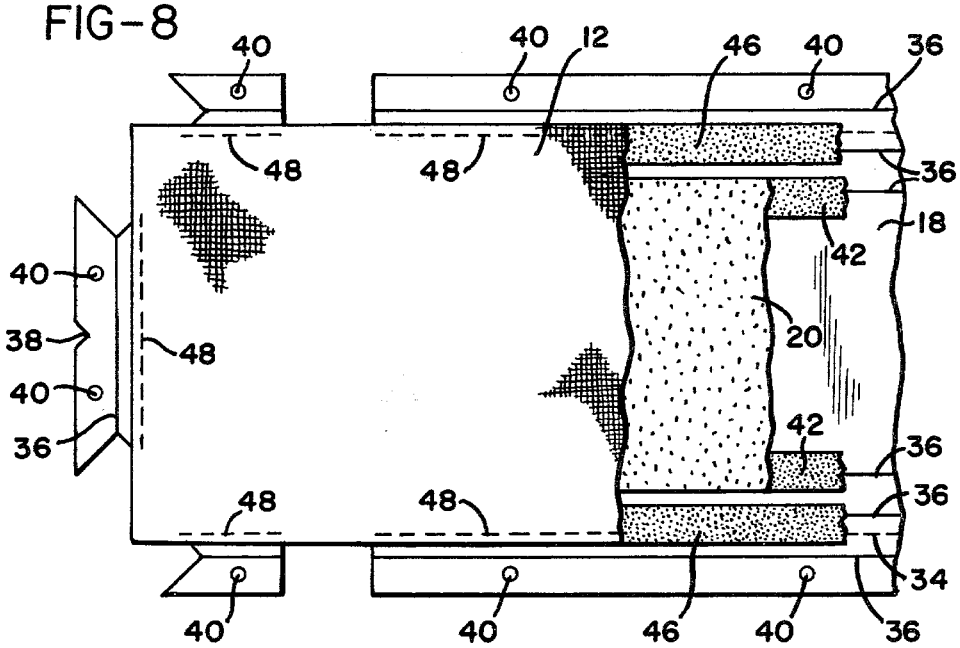
FIG. 8 is a view, similar to FIG. 7, of the left portion of the flexible sheet substrate with padding material and an upholstery material cover added.

FIG. 8 shows the upholstery means, with the padding means 20 and the upholstery material cover 12 added. Foam padding 20 is attached to substrate 18 by double-sided, pressure-sensitive adhesive tape 42. Similarly, upholstery material cover 12 is also attached to the substrate 18 by double-sided, pressure-sensitive adhesive tape 46. Additionally, upholstery material cover 12 is sewn, as indicated at 48, to the flexible sheet substrate 18 adjacent the periphery thereof. Note that the upholstery material cover 12 leaves at least a portion of the periphery of the flexible sheet substrate 18 exposed.

Figure 9:
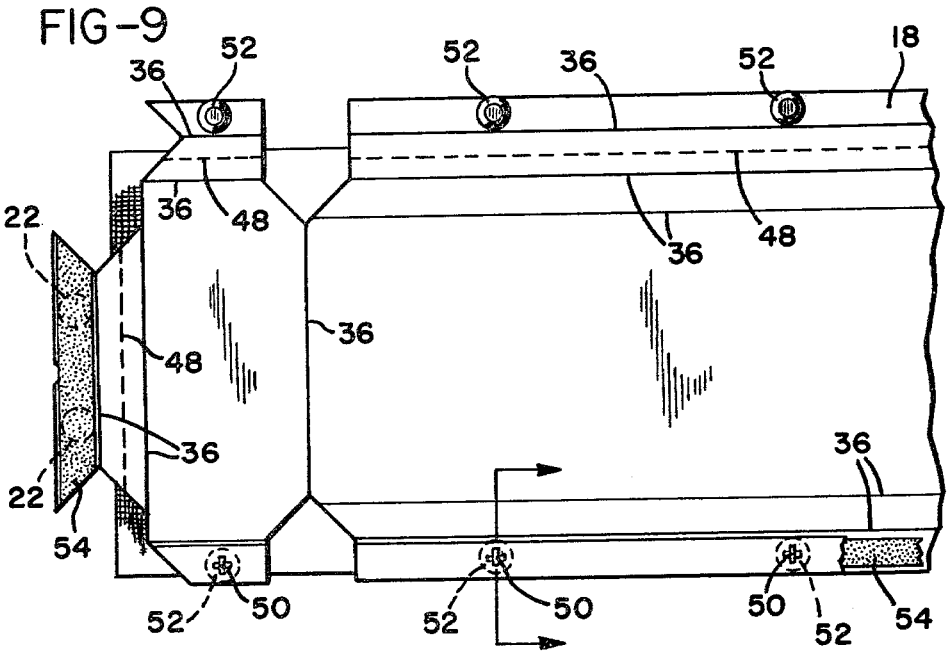
FIG. 9 is a view of the substrate, padding material, and upholstery material cover, as seen from the side opposite that shown in FIG. 8, with clip means being added.
Figure 10:
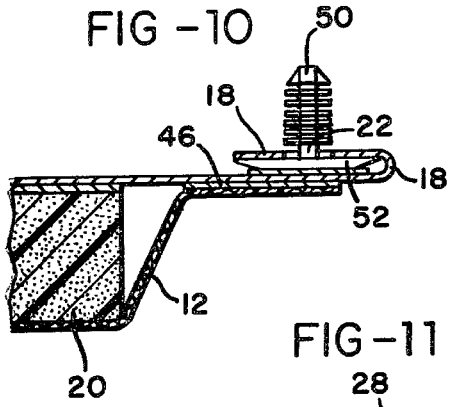
FIG. 10 is a partial enlarged sectional view taken generally along line 10—10 in FIG. 9.

FIGS. 9 and 10 illustrate the manner in which the clip means are added to the upholstery means prior to attachment of the upholstery means to the frame 16. Although the clips 22 are not illustrated in FIG. 8, it should be appreciated that the clips are typically placed in position in holes 40 prior to the addition of the foam material 20 and the upholstery material cover 12 to the flexible sheet substrate 18. As seen in FIGS. 9 and 10, each clip comprises a frame engaging portion 50, piercing the flexible sheet substrate 18, and a clip head 52, which is on the opposite side of the substrate 18 from the frame engaging portion 50. Since the frame engaging portions 50 of the clips 22 extend from the flexible sheet substrate 18 on the same side thereof as the upholstery material cover 12, the clips 22 can be inserted in the substrate 18 prior to the substrate being laid on the flat support table of a sewing machine used to sew the cover 12 to the substrate 18 as indicated at 48. It will be apparent that if the clips were inserted through the substrate 18 in the opposite direction, the substrate would not lie flat during this sewing operation.

It will be further appreciated, however, that the construction of the structural component of the present invention, as illustrated in FIGS. 5 and 6, requires that the frame engaging portions 50 of the clips 22 extend from the upholstery means on the side opposite the upholstery material cover 12. In order to accomplish this, the substrate is folded adjacent its periphery such that the exposed portion of the substrate periphery which was not covered by the upholstery material cover 12 is on the opposite side of the upholstery means from the upholstery material cover 12. As seen in FIG. 9, a double-sided pressure-sensitive adhesive tape 54 is applied to the substrate over the clip heads 52, as depicted along the left hand periphery of the substrate 18. Thereafter, as shown along the bottom periphery of the substrate 18 in FIG. 9, the exposed portion of the substrate periphery is folded over and the folded portion is adhesively secured together to maintain the fold. The clip heads 52 are therfore held within the fold. The upholstery means may now be wrapped around the three-dimensional frame and secured thereto by the clips 22.

Figure 11:
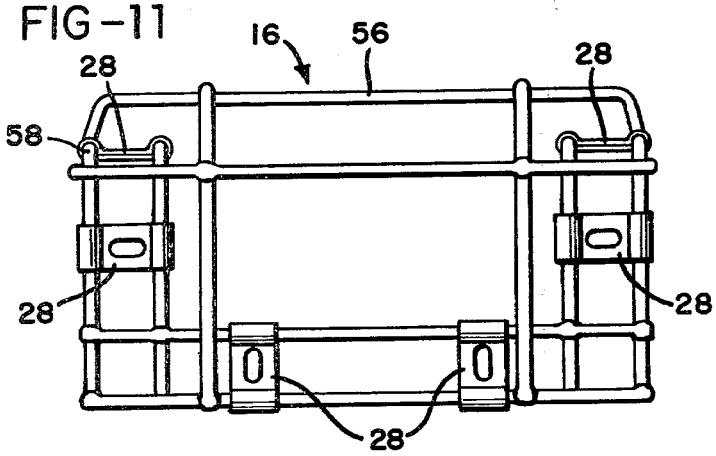
FIG. 11 is a side view of the three-dimensional frame.
Figure 12:
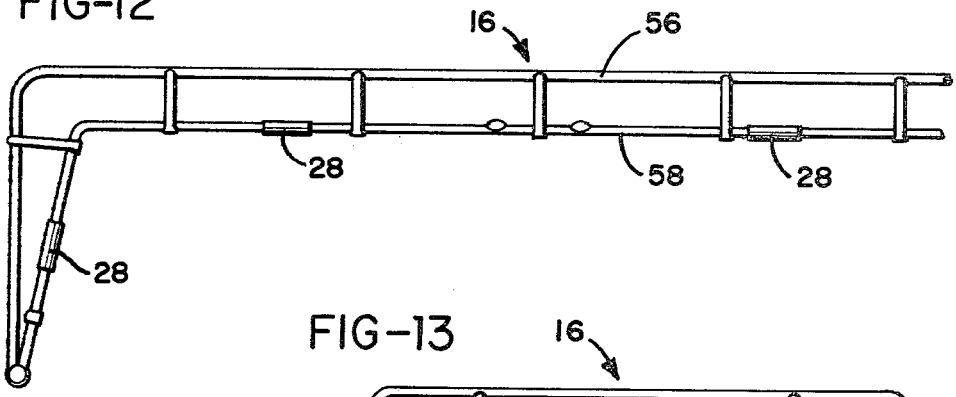
FIG. 12 is a partial front view of the three-dimensional frame.
Figure 13:
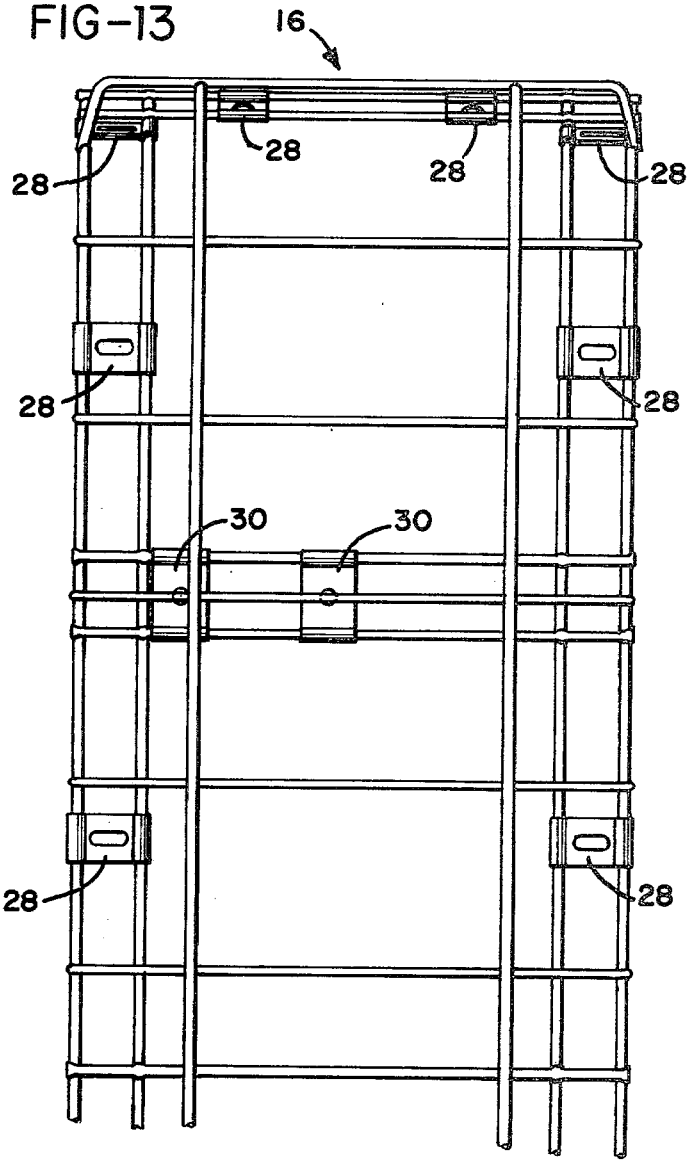
FIG. 13 is a partial plan view of the three-dimensional frame.

The three-dimensional frame of the present invention is shown in FIGS. 11–13. As seen best in FIG. 12, the frame includes a first outer wire mat 56 and a second inner wire mat 58, welded to the outer wire mat 56. As used herein, a "mat" comprises a mesh structure of crossing wires which are welded at their points of contact. The brackets 28 are provided on the second inner wire mat 58 for engaging respective ones of the clips 22. It will be appreciated that by providing a multiple mat frame structure, the component is given its three-dimensional shape and, additionally, engagement of the frame 16 by the clips 22 is facilitated. If, for instance, only a single wire mat were to be provided, and the brackets 28 mounted on that wire mat, the frame engaging portions 50 of the clips 22 would protrude upward into contact with the substrate 18. As shown in FIG. 5, however, by providing the multiple mat frame structure the portions 50 can extend upward into the space between the mats without interference.

A number of advantages over prior art constructions are realized by means of the present invention. The structural component of the present invention can be constructed rapidly by a relatively unskilled worker. The component produced is strong, fire-retardant, and mildew-proofed, as well as being lighter than components manufactured by conventional techniques.

While the method herein described, and the article constructed according to this method, constitute preferred embodiments of the invention, it is to be understood that the invention is not limited to this precise method and article and that changes may be made in either without departing from the scope of the invention.

What is claimed is:

1. A structural component for upholstered furniture, comprising: a three-dimensional wire frame including a plurality of wires welded together to form a wire mat, said wire frame including a border wire extending adjacent the outer edge of said frame, upholstery means including a flexible sheet substrate and an upholstery material cover with padding means disposed between said substrate and said cover, means securing an outer edge portion of said upholstery material cover to an adjacent outer edge portion of said substrate to confine said padding means and to form an upholstery assembly, said upholstery assembly covering said wire frame, and plastic clip means attaching said upholstery assembly to said border wire of said wire frame.

2. The structural component of claim 1 in which said three-dimensional frame comprises:

a first outer wire mat and a second inner wire mat welded to said outer wire mat, and in which a plurality of said border wires are provided on said second inner wire mat for receiving corresponding said clip means.

3. The structural component of claim 1 wherein said flexible sheet substrate is of appropriate shape for covering said frame, padding said means adhesively is mounted on said flexible sheet substrate, and said upholstery material cover, is sewn to said flexible sheet substrate adjacent the periphery thereof.

4. The structural component of claim 3 in which said clip means each comprise a clip having a frame engaging portion piercing said flexible sheet substrate and a clip head on the opposite side of said substrate from said frame engaging portion, and in which said frame engaging portion extends from said flexible sheet substrate on the same side thereof as said upholstery material cover.

5. The structural component of claim 4 in which said flexible sheet substrate is folded adjacent its periphery such that said exposed portion of said substrate periphery is on the opposite side of said upholstery means from said upholstery material cover.

6. The structural component of claim 5 in which the folded portion of said substrate is adhesively secured together to maintain the fold, with said clip heads of said clip means held within said fold.

7. The structural component of claim 1 in which said padding means is a sheet of foam material which is secured to said flexible sheet substrate by pressure-sensitive tape having adhesive on both sides thereof.

8. The structural component of claim 6 in which the folded portion of said substrate is secured by means of pressure-sensitive tape having adhesive on both sides thereof.

9. The method of making an upholstered furniture component, comprising the steps of:

forming a wire frame having multiple wire mats welded together, providing a sheet of flexible material of appropriate shape for covering said wire frame, piercing said sheet at points adjacent its periphery with a plurality of clips, said clips having frame engaging portions extending from said sheet, adhesively bonding padding material to said sheet on the same side of said sheet as said frame engaging portions of said clips, sewing upholstery material to said sheet around the periphery thereof to cover said padding material, while leaving at least a portion of the periphery of said sheet exposed, folding over said periphery of said sheet such that said frame engaging portions extend outwardly on the opposite side thereof from said upholstery material, wrapping said sheet on said frame such that said frame is covered, and engaging a mat of said frame with said clips to form a finished component.

10. The method of claim 9 of making an upholstered furniture component in which said step of folding over said periphery of said sheet comprises the step of adhesively bonding said sheet in the region of said fold, whereby said fold is secured.

11. The method of claim 9 of making an upholstered furniture component in which the step of forming a wire frame includes the steps of:

forming a first outer wire mat, consisting of wires welded together, forming a second inner wire mat consisting of wires welded together, and welding together said first outer wire mat and said second inner wire mat.

12. The method of making an upholstered furniture component of claim 11 in which the step of forming a wire frame further comprises the step of attaching a plurality of means to said second inner wire mat for engaging associated ones of said plurality of clips when said sheet is wrapped on said frame, whereby said sheet is secured to said second inner wire mat.

13. The structural component of claim 1 wherein said flexible-sheet substrate comprises a cardboard sheet having a predetermined configuration and fold lines to provide for forming said sheet around said wire frame.

14. The structure component of claim 13 wherein said cardboard sheet carries prelocated pressure sensitive adhesive means for locating said padding means on said cardboard sheet prior to mounting said sheet on said wire frame.

15. A structural component for upholstered furniture, comprising: a three-dimensional wire frame including a plurality of wires welded together to form an outer wire mat and an inner wire mat, said inner wire mat including border wires extending adjacent the outer edge portion of said frame, upholstery means including a flexible sheet substrate and an upholstery material cover with padding means disposed between said substrate and said cover, means securing an outer edge portion of said upholstery material cover to an adjacent outer edge portion of said substrate to confine said padding means and to form an upholstery assembly, said upholstery assembly covering said outer wire mat, and plastic clip means attaching said upholstery means to said border wires of said wire frame.

16. The method of making an upholstered furniture component, comprising the steps of;

forming a wire frame having multiple wires welded together and including border wires extending adjacent the outer edge portion of said frame, providing a substrate sheet of flexible material of appropriate shape for covering said wire frame, positioning padding material on said substrate sheet at a predetermined location, covering said substrate sheet and said padding material with an upholstery material and attaching said upholstery material to said substrate sheet to form an upholstery assembly, attaching plastic clip means to the outer edge portions of said upholstery assembly, wrapping said upholstery assembly on said frame to cover said frame, and attaching said clip means to said border wires of said frame.

* * * * *